US007440721B2

(12) United States Patent
Takenaka et al.

(10) Patent No.: US 7,440,721 B2
(45) Date of Patent: Oct. 21, 2008

(54) INTERMEDIATE TRANSFER BELT AND IMAGE FORMING DEVICE

(75) Inventors: Hidenori Takenaka, Osaka (JP); Shirika Saitoh, Osaka (JP); Tomoyuki Oda, Osaka (JP); Koji Murase, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 278 days.

(21) Appl. No.: 11/277,230

(22) Filed: Mar. 23, 2006

(65) Prior Publication Data

US 2006/0222422 A1 Oct. 5, 2006

(30) Foreign Application Priority Data

Mar. 30, 2005 (JP) ..... 2005-096596

(51) Int. Cl.
*G03G 15/01* (2006.01)

(52) U.S. Cl. ..... 399/302; 399/308

(58) Field of Classification Search ..... 399/159, 399/161, 162, 297, 302, 308
See application file for complete search history.

(56) References Cited

U.S. PATENT DOCUMENTS 6,830,857 B2 * 12/2004 Kabata et al. ..... 430/56

FOREIGN PATENT DOCUMENTS

| | | | |
|---|---|---|---|
| JP | H10/39642 | A | 2/1998 |
| JP | 2000-242074 | A | 9/2000 |
| JP | 2002/49211 | A | 2/2002 |
| JP | 2003-337488 | A | 11/2003 |
| JP | 2004-070159 | A | 3/2004 |
| JP | 2005-024829 | A | 1/2005 |

* cited by examiner

*Primary Examiner*—Hoan H Tran
(74) *Attorney, Agent, or Firm*—Global IP Counselors, LLP

(57) ABSTRACT

An intermediate transfer belt for an image forming device includes a laminated body including at least two layers. At least one layer of the laminated body is an elastic layer including cells that are preferably interconnected cells.

19 Claims, 4 Drawing Sheets

INTERMEDIATE TRANSFER BELT AND IMAGE FORMING DEVICE

BACKGROUND OF THE INVENTION

1. Field of the Invention

The present invention relates to an intermediate transfer belt for transferring a toner image formed on a photoconductor onto a transfer member, and an image forming device including the same.

2. Background Information

In a tandem-type color image forming device, a system is employed in which respective toner images formed on a photosensitive drum are superposed on an intermediate transfer belt, and the full color toner image formed thereby on the intermediate transfer belt is transferred onto a transfer member or transfer medium.

An intermediate transfer belt having multiple layers has been proposed in order to improve the transferability of toner images onto print media. The multilayered structure allows the intermediate transfer belt to conform to the surfaces of print media that are rough or textured.

As shown in FIG. 6, a conventional intermediate transfer belt 124 is comprised of a reinforcing layer 151 at the bottom, an elastic layer 152 in the middle, and a surface protective layer 153 at the top. The reinforcing layer 151 and the surface protective layer 153 comprise the surfaces of the intermediate transfer belt. The reinforcing layer 151 is comprised of a resin film, such as polyimide, preferably hard polyimide, or polyvinylidene fluoride (PVDF), for example. The elastic layer 152 could be made of nitrile rubber (NBR), silicone rubber, urethane, or other materials. The surface protective layer 153 could be coated with fluorocarbon polymers, Teflon™ resin, or other materials. Japan Patent Application Publication No. 10-39642 discloses a technique for determining the properties of the reinforcing layer 151 and the strength properties of the elastic layer 152 in a multilayered intermediate transfer belt.

The intermediate transfer belt 124 disclosed in Japan Patent Application Publication No. 10-39642 has a reinforcing layer 151 made of a high strength resin member, as well as an elastic layer 152 for improving transferability. However, one problem with the material of the elastic layer 152 is that the hardness thereof cannot be reduced to a significant degree, and the thickness thereof cannot be increased. If there are restrictions on the hardness and thickness thereof, then this will limits the extent to which the transferability of the intermediate transfer belts could be improved. In particular, when transferring images onto paper having a very rough or textured surface, good transfer will not be obtained if there are restrictions on the improvement in transferability.

In addition, Japan Unexamined Patent Publication No. 2002-49211 discloses that when a transfer belt is positioned around a fixing device, or when a thermal transfer system is employed, the temperature of the intermediate transfer belt 124 will change, thermal expansion of the intermediate transfer belt 124 will occur, and problems such as smearing of the color image will occur.

In view of the above, it will be apparent to those skilled in the art from this disclosure that there exists a need for an improved intermediate transfer belt that is capable of improving the transfer performance to a transfer member, and capable preventing the smearing of color images from occurring if the temperature of the intermediate transfer belt is changed, as well as a need for an improved image forming device having the same. This invention addresses this need in the art as well as other needs, which will become apparent to those skilled in the art from this disclosure.

SUMMARY OF THE INVENTION

As a result of diligent research in order to solve the aforementioned problems, the present inventors discovered that with an intermediate transfer belt for an image forming device having a laminated body comprising at least two layers and temporarily holding a toner image formed on the photoconductor, the transfer performance can be improved, and smearing of color images and the like due to the thermal expansion of the intermediate transfer belt can be inhibited, by making at least one layer therein an elastic layer having cells, preferably interconnected cells, in the interior thereof.

An intermediate transfer belt according to the present invention is an intermediate transfer belt for an image forming device. The intermediate transfer belt comprises a laminated body for temporarily holding a toner image transferred from a photoconductor, a first surface layer, and a first elastic layer containing cells in the interior thereof.

The cells of the elastic layer are preferably interconnected cells.

An image forming device according to the present invention comprises at least one image support medium having a surface on which a toner image is formed; an intermediate transfer belt onto which a plurality of toner images are sequentially transferred from the image support medium; a secondary transfer unit for transferring the toner images on the intermediate transfer belt onto print media; a transfer media feeding mechanism for feeding the print media between the intermediate transfer belt and the secondary transfer unit. The intermediate transfer belt includes a first surface layer and a first elastic layer containing cells in the interior thereof.

According to the present invention, the intermediate transfer belt is provided in order to temporarily hold the transferred toner images transferred from a photoconductor. The intermediate transfer belt is constructed with laminated layers, with at least one of the layers being an elastic layer containing cells in the interior thereof. By having this elastic layer, it will be possible to easily adjust the hardness and the thickness of the intermediate transfer belt and the elastic layer. As a result, the intermediate transfer belt can conform more closely to the surface of the transfer media than was previously possible, and the transfer performance to the transfer media will be improved, particularly when transferring an image to paper having a highly rough or textured surface.

In addition, if the temperature of the intermediate transfer belt is changed like in a thermal transfer system, the cells will reduce the thermal expansion of the intermediate transfer belt, and therefore, it is possible to prevent the thermal deformation of the intermediate transfer belt. Consequently, even if the temperature of the intermediate transfer belt is changed, it is possible to inhibit smearing of the color image.

According to the preferred embodiment of the present invention, the cells are interconnected cells, and therefore able to more effectively reduce the thermal expansion of the intermediate transfer belt.

According to the image forming device of the present invention, it is possible to provide high transfer performance, and inhibit smearing of a color image, even if the temperature of the intermediate transfer belt is changed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Intermediate Transfer Belt

Figure 1:
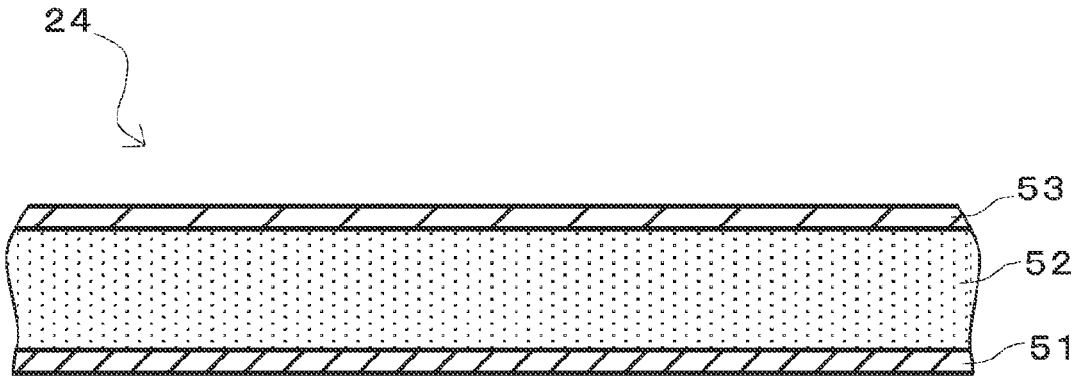
FIG. 1 is a schematic sectional view showing one example of an intermediate transfer belt according to the present invention.

An intermediate transfer belt according to the present invention will be described with reference to the drawings. FIG. 1 is a cross-sectional view showing an example of an intermediate transfer belt according to the present invention. An intermediate transfer belt 24 shown in FIG. 1 comprises a laminated body having at least two layers. Specifically, a surface protective layer 53 as the first surface layer, an elastic layer 52, and a reinforcing layer 51 as the second surface layer are laminated in this order. In other words, the reinforcing layer 51 and the surface protective layer 53 comprise the surfaces of the intermediate transfer belt 24. Note that the phrase "at least one layer contains cells in the interior thereof" appearing herein refers to the elastic layer 52.

By having the elastic layer 52 containing the cells in the interior thereof, it will be easy to adjust the hardness and the thickness of the intermediate transfer belt 24 by adjusting the hardness and the thickness of the elastic layer 52. And if the hardness and the thickness of the intermediate transfer belt 24 are adjustable, the hardness and the thickness thereof can be optimized in order to improve the transfer performance with respect to the transfer media, and particularly the transfer performance with respect to paper having a highly rough or textured surface. Note that the intermediate transfer belt 24 has a thickness ranging from about 0.1 to 1 mm, preferably from about 0.1 to 0.5 mm, in view of improving transfer performance to the transfer media. In addition, the intermediate transfer belt 24 has a JIS-A hardness of about 10 to 50 degrees, preferably about 10 to 30 degrees, in view of improving transfer performance.

Furthermore, since the intermediate transfer belt 24 shown in FIG. 1 has the elastic layer 52 that contains cells, it will be possible to inhibit the thermal expansion of the intermediate transfer belt 24 in a system in which the temperature of the intermediate transfer belt 24 is changed, such as a thermal transfer system. That is, it is possible to inhibit thermal deformation of the intermediate transfer belt 24. If thermal deformation can be inhibited, it will be possible to inhibit smearing of a color image in a thermal transfer system in which heat is applied to the intermediate transfer belt.

The intermediate transfer belt 24 shown in FIG. 1 has the elastic layer 52, which is a single layer structure containing cells, on top of the reinforcing layer 51 made of a resin film. Compared to a multilayered elastic layer composed of a layer with cells and a layer without cells, by using the single layered elastic layer 52 with cells, it will be possible to widely adjust the hardness and the thickness of the elastic layer 52, and have a large number of cells that will inhibit thermal expansion in the intermediate transfer belt 24.

The reinforcing layer 51 reinforces the strength of the intermediate transfer belt 24, and is more rigid than the elastic layer 52. The reinforcing layer 51 is made of a resin film such as a polyimide, preferably a hard polyimide film, a polyvinylidene fluoride (PVDF) film, or a polycarbonate film. The reinforcing layer 51 has a thickness ranging from about 0.05 to 0.2 mm, preferably from about 0.05 to 0.1 mm.

The elastic layer 52 contains cells as shown in FIG. 1. The cells to be utilized here could be closed cells (isolated cells) or interconnected cells, for example. In the present invention, it is preferable to utilize interconnected cells. The interconnected cells are connected with each other to allow gas to pass between the cells. If the cells are connected with each other, it will be possible to effectively inhibit thermal expansion of the intermediate transfer belt 24 because air will be able to pass through the cells and be exhausted from the intermediate transfer belt 24.

The material with interconnected cells in the elastic layer 52 could be a polyurethane interconnected cell body, a nitrile rubber interconnected cell body, or a silicone rubber interconnected cell body, for example. Furthermore, in producing such an interconnected cell body, calcium carbonate, for example, could be used as a blowing agent. Note that in the present invention, it is preferable to utilize a urethane interconnected cell body.

A material with closed cells can also be used, such as a polyurethane closed cell body, a nitrile rubber closed cell body, or a silicone rubber closed cell body, for example.

The elastic layer 52 has a JIS-A hardness of about 10 to 50 degrees, and preferably about 10 to 30 degrees. If the hardness of the elastic layer 52 is adjusted to be within this range, the elastic layer 52 and the intermediate transfer belt 24 can closely conform to the surface of the transfer media, and improve transferability. Moreover, the elastic layer 52 has a thickness ranging from about 0.2 to 1 mm, preferably from about 0.2 to 0.5 mm. In the past, an increase in the thickness of the intermediate transfer belts was not possible because of the material or the shape thereof. However, if the intermediate transfer belt 24 has the elastic layer 52 containing cells, the elastic properties of the intermediate transfer belt 24 and the elastic layer 52 can be improved, thus enhancing the transfer performance to transfer media.

In addition, in a system such as a thermal transfer system, where the temperature of the intermediate transfer belt 24 varies, it is preferable that the foaming ratio (%), i.e., the ratio of the amount of air in the elastic layer 52, is about 30 to 50% in order to inhibit the thermal expansion of the intermediate transfer belt 24. In addition, it is preferable to employ an elastic layer 52 containing interconnected cells. Note that the foaming ratio (%) can be obtained by the following equation.

Foaming density (%)=[(W1−W2)/W1]×100, wherein

W1: weight per unit volume (g/cm3) of non-foamed material, W2: weight per unit volume (g/cm3) of foamed material.

The surface protective layer 53 can be a layer made of a fluorocarbon polymer, or Teflon™ resin, for example. Preferably, the surface protective layer 53 has a thickness ranging from about 0.003 to 0.01 mm.

Figure 2:
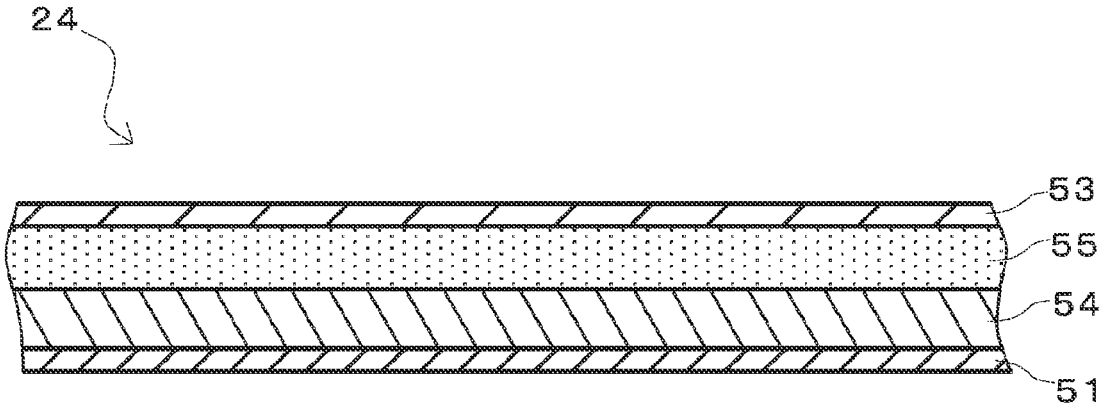
FIG. 2 is a schematic sectional view showing another example of an intermediate transfer belt according to the present invention.

Furthermore, depending on usage, the elastic layer could also be composed of a plurality of layers, where only one of the layers contains cells, or two or more layers contain cells. Here too, the cells are preferably interconnected cells. This is because if the entire elastic layer 52 contains cells, as shown in FIG. 1, the elastic layer 52 may not have sufficient strength, and may be damaged even if it includes a reinforcing layer 51, depending on the purpose of the intermediate transfer belt. FIG. 2 shows another example of the intermediate transfer belt 24 according to the present invention. Here, the elastic layer has two layers comprising a first elastic layer 54, and a second elastic layer 55 that contains an interconnected cell body. The first elastic layer 54 can be made of nitrile rubber (NBR), silicone rubber, or urethane, for example. The second elastic layer 55 may employ a cell body similar to that of the elastic layer 52 having a single layer structure.

Manufacturing Method of Intermediate Transfer Belt

The manufacturing method of the intermediate transfer belt 24 is not particularly limited. For example, it could be manufactured by a well known method of forming a laminated structure by reactively curing a liquid material. More specifically, it could be manufactured by a centrifugal molding method.

As an example of a manufacturing method, a centrifugal forming device could be used to manufacture an intermediate transfer belt having a reinforcing layer, an intermediate layer, and a surface protective layer. The reinforcing layer could be made of polyvinylidene fluoride (PVDF), with a thickness of about 0.1 mm. The single layered, intermediate layer can be made of nitrile rubber (NBR) to which carbon black was added and foamed, and have a thickness of about 0.3 mm. The surface protective layer can be made of fluorocarbon polymer having a thickness of about 0.01 mm.

Image Forming Device

Figure 3:
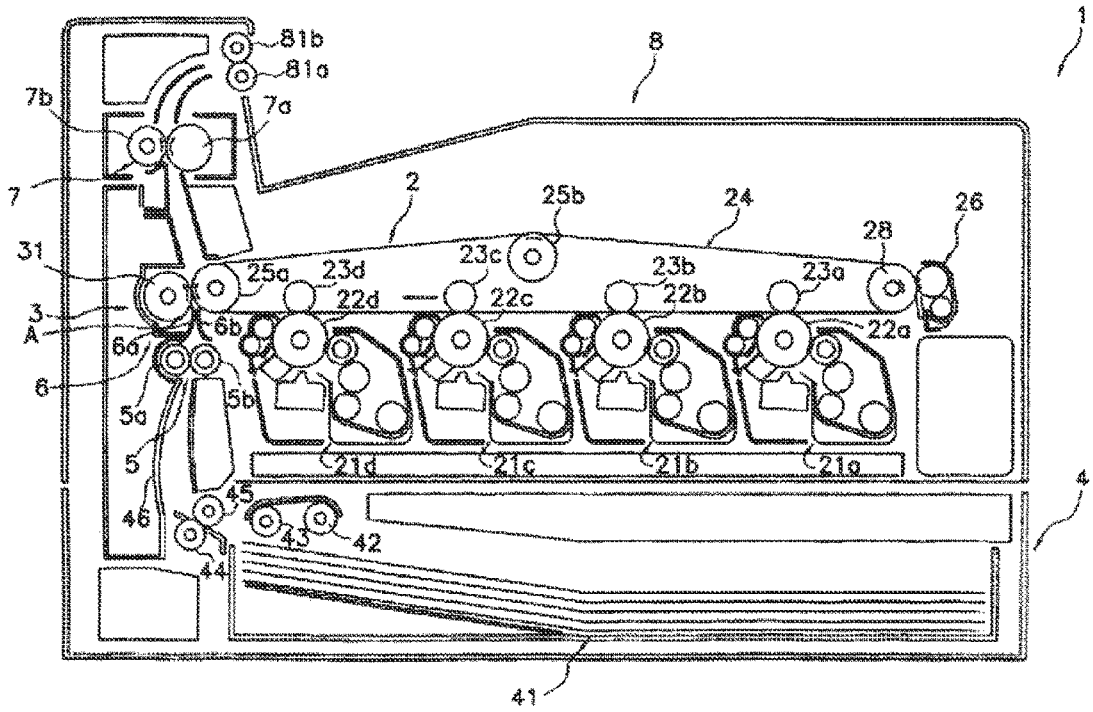
FIG. 3 is a schematic diagram showing one example of an image forming device according to the present invention.

FIG. 3 shows an example of an image forming device according to the present invention, and the structure of the main portions of a tandem-type color printer 1. The color printer 1 includes an image forming unit 2 for forming a color image, a transfer unit 3 for transferring toner images formed by the image forming unit 2 onto transfer media, a sheet feeding unit 4 for feeding transfer media, a paper stop roller 5 for transferring the transfer media in sync with the formed image, a transfer media conveyance guide mechanism 6 for guiding the transfer media at the paper stop roller 5 to a transfer position, a fixing unit 7 for fixing the toner images that are transferred to the transfer media, and a print receiving unit 8 for discharging the transfer media.

The image forming unit 2 is mounted substantially in the center of the color printer 1, and includes four image forming units 21*a*, 21*b*, 21*c*, and 21*d* having photosensitive drums 22*a*, 22*b*, 22*c*, and 22*d* respectively, each of the photosensitive drums having a surface on which an electrostatic latent image is formed in correspondence with four colors, i.e., black, yellow, cyan, and magenta, primary transfer rollers 23*a*, 23*b*, 23*c*, and 23*d* respectively arranged opposite the photosensitive drums 22*a*, 22*b*, 22*c*, and 22*d* for transferring the toner images formed on the surface of the corresponding photosensitive drums, and an intermediate transfer belt 24. Note that the developing system may be a contact development system for bringing a developing layer into contact with a photosensitive drum, or a jumping development system in which the developing roller and the photosensitive drum do not come into contact with each other.

Figure 4:
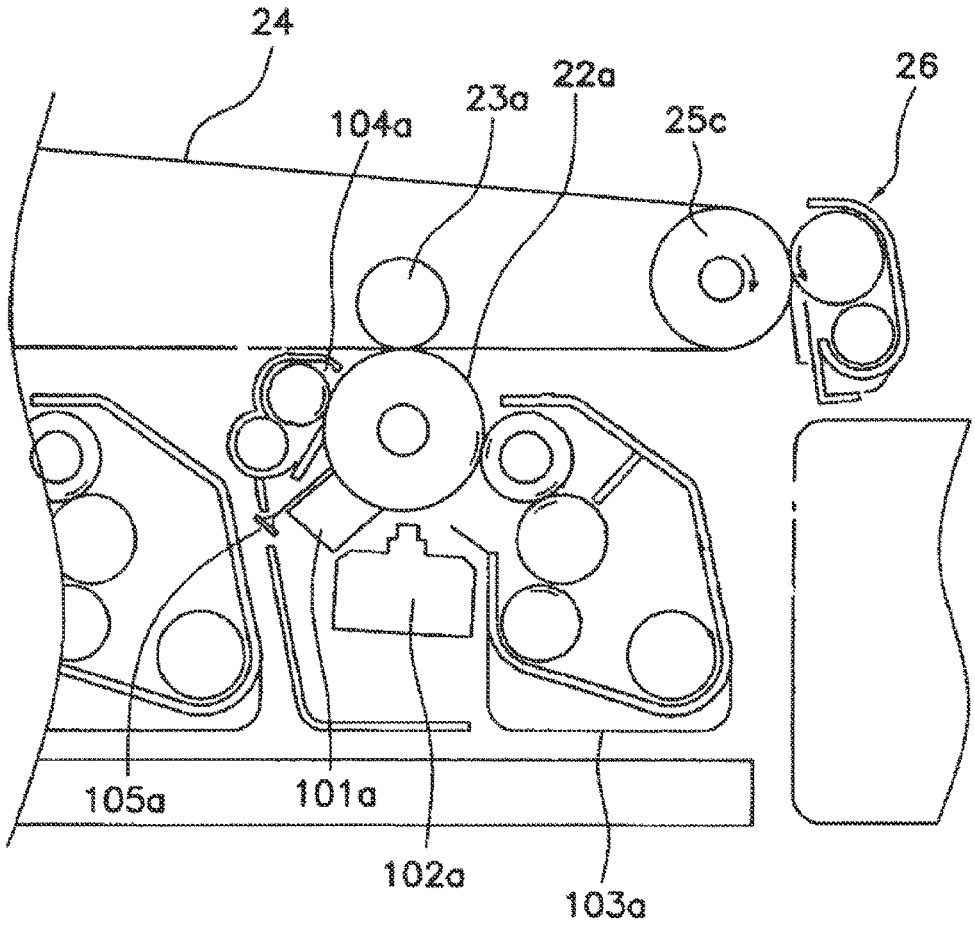
FIG. 4 is a detailed diagram showing an image forming unit of the image forming device shown in FIG. 3.

Here, the internal configurations of the four image forming units corresponding to the four colors black, yellow, cyan, and magenta are the same, and thus the configuration of the black image forming unit 21*a* will be used as an example. As shown in FIG. 4, a charge unit 101*a*, an exposure unit 102*a*, a developing unit 103*a*, a cleaning unit 104*a*, and a neutralization unit 105*a* are arranged around the photosensitive drum 22*a* of the black image forming unit 21*a*.

In the transfer unit 3, a secondary transfer roller 31 is brought into contact with the intermediate transfer belt 24 to transfer a full color toner image formed on the intermediate transfer belt 24 to a transfer medium, e.g., a sheet of paper, by applying a secondary transfer bias to the secondary transfer roller 31.

The sheet feeding unit 4 is located at the bottom of the image forming unit 2, and includes a cassette 41 for storing sheets, pick-up rollers 42 and 43 for picking up the sheets stored therein, and a pair of feed rollers 44, 45 for sending sheets one by one into the conveyance path. The sheet conveyed from the sheet feeding unit 4 is transported to a transfer position through a vertical conveyance path 46. On the downstream end of the vertical conveyance path 46 in a sheet conveying direction, a pair of paper stop rollers 5*a* and 5*b* is provided. The pair of paper stop rollers 5*a* and 5*b* holds the sheet conveyed from the sheet feeding unit 4, and then sends it to the transfer position A in sync with the image formation on the intermediate transfer belt 24.

The fixing unit 7 is located above the transfer unit 3, and fixes the toner image transferred onto the sheet by fusion. The fixing unit 7 includes a heat roller 7*a* having a built-in heater and a pressure roller 7*b* pressing against the heat roller 7*a*, pinches the sheet therebetween so as to convey the sheet, and fixes the toner image transferred onto the sheet surface by heat. Above the fixing unit 7, discharge rollers 81*a* and 81*b* are provided. The sheet with the toner image formed thereon is discharged onto the print receiving unit 8 on the uppermost portion of the color printer 1 via the discharge rollers 81*a* and 81*b*.

The intermediate transfer belt 24 is arranged above the respective photosensitive drums 22*a*, 22*b*, 22*c*, and 22*d* as shown in FIG. 3. The intermediate transfer belt 24 is looped around a drive roller 25*a* that is rotatively driven by driving means such as a motor for example, not shown in the figure, and a driven roller 28 located away from the drive roller 25*a*. A tension roller 25*b* is located between the drive roller 25*a* and the follow roller 28. The tension roller 25*b* is driven by a tension adjustment mechanism, not shown in the figure, to maintain a tension on the intermediate transfer belt 24.

The primary transfer rollers 23*a*, 23*b*, 23*c*, and 23*d* are respectively urged to press against the photosensitive drums 22*a*, 22*b*, 22*c*, and 22*d* via the intermediate transfer belt 24. As a result, the intermediate transfer belt 24 is in contact with the photosensitive drums 22*a*, 22*b*, 22*c*, and 22*d* due to this pressure. In a position facing the driven roller 28, an intermediate transfer belt cleaning device 26 is provided in order to clean residual toner remaining on the intermediate transfer belt 24.

The intermediate transfer belt 24 described above is mounted in the color printer 1. That is, the intermediate transfer belt 24 including the elastic layer containing cells in the interior thereof is provided. If such an intermediate transfer belt is used, the elastic layer and the intermediate transfer belt 24 can closely conform to the transfer media more than was previously possible, and can improve transfer performance to the transfer media, particularly when the transfer media has a rough or textured surface.

Figure 5:
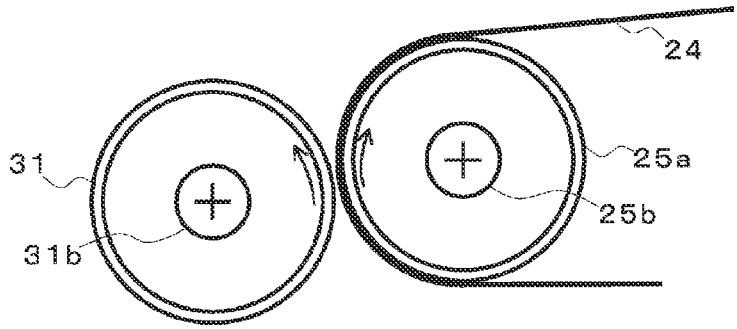
FIG. 5 is a detailed diagram showing a drive roller and a secondary transfer roller of the image forming device shown in FIG. 3.
Figure 6:
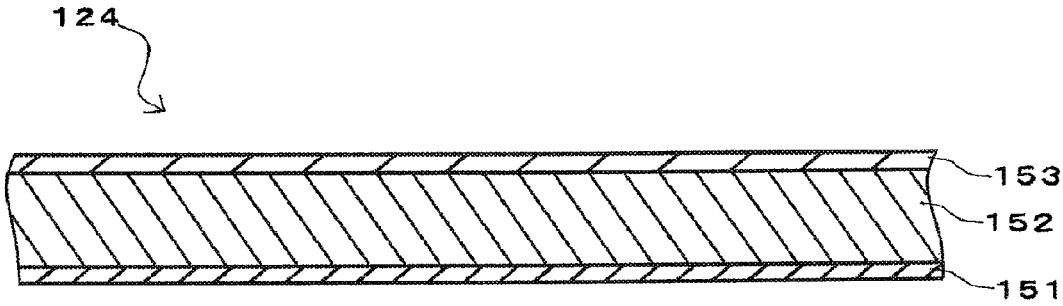
Fig. 6 ( Prior Art )
FIG. 6 is a schematic sectional view showing a conventional intermediate transfer belt.

The tandem-type color printer 1 is a printer employing a thermal transfer system. More specifically, as shown in FIG. 5, the drive roller 25*a* and the secondary transfer roller 31 have built-in heaters 25*b* and 31*b*, respectively. The heaters 25*b* and 31*b* apply heat to the intermediate transfer belt 24 for heat-fusion printing, thereby improving transferability. In the color printer 1, the intermediate transfer belt 24 is heated while the cells, for example interconnected cells, in the intermediate transfer belt 24 reduce the thermal expansion. Thus, it is possible to inhibit smearing of color images.

A description of an image forming operation is provided below. First, when the color printer 1 is turned on, a variety of parameters are initialized such as the temperature of the fixing unit 7. An image data input portion, not shown in the figures, receives image data from a personal computer connected through a network. The image data received here is transmitted to the image forming unit 2.

The respective image forming units 21*a*, 21*b*, 21*c*, and 21*d* of the image forming unit 2 form a toner image based on the image data received. Below, the image forming operation will be described by using the black image forming unit 21*a* as an example. First, the charge unit 101*a* charges the photosensitive drum 22*a*. The exposure unit 102*a* exposes the photosensitive drum 22*a* based on the black image data to form an electrostatic latent image on the surface of the photosensitive drum 22*a*. The electrostatic latent image is developed into a toner image by the black developing unit 103*a*. The toner image formed on the photosensitive drum 22*a* is transferred onto the intermediate transfer belt 24 by applying a transfer bias (constant-current control) to the primary transfer roller 23*a*. Note that the residual developing agent remaining on the photosensitive drum 22*a* is cleaned by the cleaning unit 104*a*, and discarded into a waste toner container not shown in the figure. The neutralization unit 105*a* neutralizes the electrical charge remaining on the photosensitive drum 22*a*. This operation is carried out color by color by the remaining three image forming units, i.e., the magenta image forming unit 21*b*, the cyan image forming unit 21*c*, and the yellow image forming unit 21*d*. Consequently, a full color toner image is formed on the intermediate transfer belt 24.

Meanwhile, in the sheet feeding unit 4, a sheet of paper is picked up by the pick-up rollers 42 and 43 from the sheet feeding cassette 41, and sent into the vertical conveyance path 46 through the pair of feed rollers 44 and 45. Then, the sheet is conveyed by the pair of paper stop rollers 5*a* and 5*b* at precisely the same timing as the image formation on the intermediate transfer belt 24. The sheet is guided to the transfer unit 3 by the transfer media conveyance guide mechanism 6. In the transfer unit 3, the secondary transfer roller 31 is brought into contact with the intermediate transfer belt 24 in order to transfer the full color toner image on the intermediate transfer belt 24 onto the sheet by applying the secondary transfer bias to the secondary transfer roller 31. Note that in the tandem-type color printer 1, the heater 25*b* and the heater 31*b* apply heat to the intermediate transfer belt 24 to perform a thermal transfer. The full color toner image transferred to the sheet is fixed onto the sheet by heat and pressure in the fixing unit 7, and the sheet with the full color toner image formed thereon is discharged onto the print receiving unit 8. In addition, the toner remaining on the intermediate transfer belt 24 is cleaned by the intermediate transfer belt cleaning device 26, and discarded into a waste toner container not shown in the figure.

In this image forming process, when the drive roller 25*a* is driven by rotation of a driving device, not shown in the figure, the intermediate transfer belt 24 starts to circulate. Then, the sheet sent from the pair of paper stop rollers 5*a* and 5*b* at precisely the same timing as the image formation on the intermediate transfer belt 24, is conveyed into the nip between the secondary transfer roller 31 and the intermediate transfer belt 24. The secondary transfer roller 31 is pressed against the intermediate transfer belt 24. In addition, since the intermediate transfer belt 24 is looped around the drive roller 25*a*, the secondary transfer roller 31 is pressed against the drive roller 25*a* via the intermediate transfer belt 24. Here, in the transfer unit 3, when a sheet reaches the transfer nip, the secondary transfer roller 31 presses against the sheet, so that the sheet is in contact with the toner image formed on the intermediate transfer belt 24 to allow the toner image on the intermediate transfer belt 24 to transfer onto the sheet.

The developing agent in the present invention could be a one-component developing agent comprised of nonmagnetic toner, or a two-component developing agent comprised of nonmagnetic toner and magnetic carrier, such as iron powder and ferrite for example. The volume average particle diameter of the toner particles range from about 3 to 10 μm, preferably about 4 to 7 μm, irrespective of whether it is a one or a two-component developing agent. The toner comprises at least a binding resin and a colorant, and includes an inorganic oxide as an abrasive when necessary.

The binder resin can be any kind of binding resin, for example thermoplastic resins such as polystyrene resin, acrylic resin, styrene-acrylic copolymer, polyethylene resin, polypropylene resin, polyvinyl chloride resin, polyester resin, polyamide resin, polyurethane resin, polyvinyl alcohol resin, vinyl ether resin, N-vinyl resin, or styrene-butadiene resin. The binder resin can also be a thermoplastic resin with a thermosetting resin added to it. The thermosetting resin could be an epoxy resin, or a cyanate resin, for example.

The colorant can include the following pigments. A black pigment can be carbon black such as acetylene black, lamp black, aniline black, for example. A yellow pigment can be chrome yellow, zinc yellow, cadmium yellow, yellow iron oxide, mineral fast yellow, nickel titanium yellow, nable yellow, naphthol yellow S, Hansa yellow G, Hansa yellow 10G, benzidine yellow G, benzidine yellow GR, quinoline yellow lake, permanent yellow NCG, or tartrazine lake, for example. An orange pigment can be red/yellow lead, molybdate orange, permanent orange GTR, pyrazolone orange, Balkan orange, indanthrene brilliant orange RK, benzidine orange G, or indanthrene brilliant orange GK, for example. A red pigment can be colcothar, cadmium red, red lead, mercuric sulfide cadmium, permanent red 4R, lithol red, pyrazolone red, watching red calcium salt, lake red D, brilliant carmine 6B, eosin lake, rhodamine lake B, alizarin lake, or brilliant carmine 3B, for example. A violet pigment can be manganese violet, fast violet B, or methyl violet lake, for example. A blue pigment can be iron blue, cobalt blue, alkali blue lake, Victoria blue lake, phthalocyanine blue, metal-free phthalocyanine blue, phthalocyanine blue part chloride compound, fast sky blue, or indanthrene blue BC, for example. A green pigment can be chrome green, chromium oxide, pigment green B, malachite green lake, or fanal yellow green G, for example. A white pigment can be zinc oxide, titanium oxide, antimony white, or zinc sulfide, for example. A white pigment can be barites, barium carbonate, clay, silica, white carbon, talc, alumina white, for example. The amount of the colorants allowed in the binding resin, with respect to a binding resin with a mass of 100 units, ranges from about 2 to 20 units by weight, and is preferably in the range of about 5 to 15 units by weight.

In addition, inorganic oxides, such as alumina, titanium oxide, zinc oxide, magnesium oxide, for example, can be added to the toner as an additive. The additive can have a volume average particle diameter of about 0.02 to 1.0 μm, and preferably about 0.1 to 0.3 μm.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2005-096596. The entire disclosure of Japanese Patent Application No. 2005-096596 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An intermediate transfer belt for an image forming device, comprising:

a laminated body configured to temporarily hold a toner image transferred thereto from a photoconductor, the laminated body comprising a first surface layer, and a first elastic layer having cells in the interior thereof.

2. An intermediate transfer belt according to claim 1, wherein the cells of the first elastic layer are interconnected cells that are connected with each other.

3. An intermediate transfer belt according to claim 2, wherein the first elastic layer comprises an interconnected cell body comprising polyurethane, an interconnected cell body comprising nitrile rubber, or an interconnected cell body comprising silicone rubber.

4. An intermediate transfer belt according to claim 3, wherein calcium carbonate is used as a blowing agent in the production of the first elastic layer.

5. An intermediate transfer belt according to claim 1, wherein the first elastic layer has JIS A hardness of about 10 to 50 degrees.

6. An intermediate transfer belt according to claim 5, wherein the first elastic layer has JIS A hardness of about 10 to 30 degrees.

7. An intermediate transfer belt according to claim 1, wherein the first elastic layer has a thickness of about 0.2 mm to 1.0 mm.

8. An intermediate transfer belt according to claim 7, wherein the first elastic layer has a thickness of about 0.2 mm to 0.5 mm.

9. An intermediate transfer belt according to claim 1, wherein the first elastic layer has a foaming density between about 30% to 50%, wherein the foaming density is expressed by the following equation:

$$[(W1-W2)/W1]\times 100$$

and wherein

W1 is the weight per unit volume ($g/cm^3$)of a non-foamed material; and

W2 is the weight per unit volume ($g/cm^3$) of the foamed material.

10. An intermediate transfer belt according to claim 9, wherein the image forming device performs thermal transfer by applying heat to the intermediate transfer belt.

11. An intermediate transfer belt according to claim 1, wherein the first surface layer serves to protect the surface of the intermediate transfer belt, and is comprised of a fluorocarbon polymer film or a Teflon™ film.

12. An intermediate transfer belt according to claim 11, wherein the first surface layer has a thickness of about 0.003 mm to 0.01 mm.

13. An intermediate transfer belt according to claim 1, further comprising a second surface layer formed on the surface of the first elastic layer opposite the first surface layer.

14. An intermediate transfer belt according to claim 13, wherein the second surface layer has a stiffness that is higher than the first elastic layer.

15. An intennediate transfer belt according to claim 14, wherein the second surface layer is comprised of a resin film selected from the group consisting of polyimide, polyvinylidene fluoride, and polycarbonate.

16. An intermediate transfer belt according to claim 15, wherein the second surface layer has a thickness of about 0.05 mm to 0.2 mm.

17. An intermediate transfer belt according to claim 16, wherein the second surface layer has a thickness of about 0.05 mm to 0.1 mm.

18. An intermediate transfer belt according to claim 1, further comprising a second elastic layer laminated on the first elastic layer.

19. An image forming device, comprising:

at least one image support medium onto which a toner image can be formed;

an intermediate transfer belt onto which a plurality of toner images can be sequentially transferred from the image support medium, the intermediate transfer belt comprising a first surface layer and a first elastic layer having cells in the interior thereof;

a secondary transfer unit configured to transfer toner images on the intermediate transfer belt onto transfer media; and a transfer media feeding mechanism configured to feed the transfer media between the intermediate transfer belt and the secondary transfer unit.

* * * * *